US007758472B2

(12) United States Patent
Stewart

(10) Patent No.: US 7,758,472 B2
(45) Date of Patent: Jul. 20, 2010

(54) EXERCISE DEVICE RAMP ROLLER RETAINER

(75) Inventor: Jonathan M. Stewart, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 78 days.

(21) Appl. No.: 12/154,915

(22) Filed: May 28, 2008

(65) Prior Publication Data

US 2009/0298651 A1 Dec. 3, 2009

(51) Int. Cl.
*A63B 22/00* (2006.01)
*A63B 22/04* (2006.01)

(52) U.S. Cl. ..... 482/52; 482/51

(58) Field of Classification Search ..... 482/51–53, 482/57, 70, 72–73, 135; 104/93, 95, 107, 104/119
See application file for complete search history.

(56) References Cited

U.S. PATENT DOCUMENTS 660,999 A * 10/1900 Richard ..... 104/109
3,892,404 A * 7/1975 Martucci ..... 482/96
4,541,627 A * 9/1985 MacLean et al. ..... 482/73
4,695,050 A * 9/1987 Smith et al. ..... 482/73
4,756,523 A * 7/1988 Rasmussen ..... 482/73
4,867,440 A * 9/1989 Saarinen ..... 482/73
4,974,832 A * 12/1990 Dalebout ..... 482/72
5,685,804 A 11/1997 Whan-Tong et al. ..... 482/51
6,146,313 A 11/2000 Whan-Tong et al. ..... 482/51
6,482,130 B1 11/2002 Pasero et al. ..... 482/51
6,490,832 B1 * 12/2002 Fischbach et al. ..... 52/207
6,749,540 B1 6/2004 Pasero et al. ..... 482/52
6,767,314 B2 * 7/2004 Thompson ..... 482/96
6,939,271 B1 9/2005 Whan-Tong et al. ..... 482/52
6,971,976 B2 * 12/2005 Endelman et al. ..... 482/121
2006/0116247 A1 6/2006 Dyer et al. ..... 482/52
2006/0189445 A1 8/2006 Stewart et al. ..... 482/52
2006/0189447 A1 8/2006 Dyer et al. ..... 482/52
2006/0281604 A1 12/2006 Stewart et al. ..... 482/51
2007/0015633 A1 * 1/2007 Gerschefske et al. ..... 482/52

* cited by examiner

*Primary Examiner*—Steve R Crow
(74) *Attorney, Agent, or Firm*—Terence P. O'Brien; Todd A. Rathe

(57) ABSTRACT

An exercise device as a member configured to be driven by one or more feet, a roller rotationally coupled to the first member and a first projection extending away from the first roller. The exercise device includes a roller guide including an inclined floor underlying the roller and overhang extending over the projection opposite a first side of the roller.

23 Claims, 4 Drawing Sheets

EXERCISE DEVICE RAMP ROLLER RETAINER

CROSS-REFERENCE TO RELATED PATENT APPLICATIONS

The present application is related to U.S. Pat. No. 6,752,744 which issued on Jun. 22, 2004 to Arnold et al. and is entitled EXERCISE DEVICE, the full disclosure which is hereby incorporated by reference.

BACKGROUND

Some exercise device may include an inclined ramp along which one or more rollers roll. Retaining the rollers upon the ramp may be difficult, complex and expensive.

DETAILED DESCRIPTION OF THE EXAMPLE EMBODIMENTS

Figure 1:
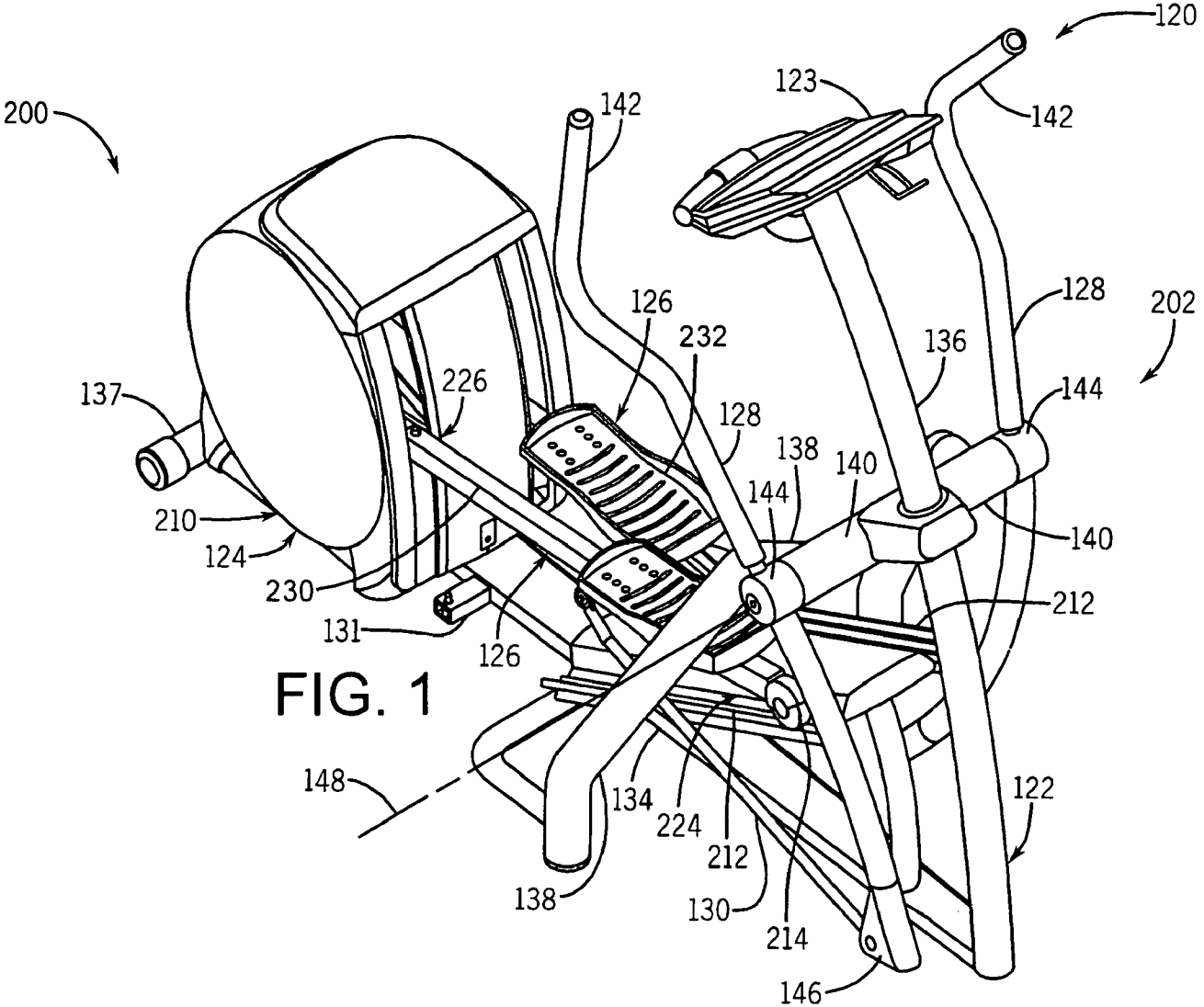
FIG. 1 is a top perspective view of an exercise device according to an example embodiment.

FIGS. 4-8 illustrate exercise device 120 according to an example embodiment. Exercise device 120 includes a ramp along which rollers reciprocate during exercise. As we described hereafter, and exercise device 120 reliably retains the rollers along the ramp during exercise in a less complex and more compact manner. As shown by FIG. 1, exercise device 120 includes frame 122, control interface 123, guide 124, foot links 126, swing arms 128 and connection linkages 130.

Frame 122 comprises one or more structures configured to support the remaining structures are components of exercise device 120 relative to a wall or floor. In the particular example illustrated, frame 122 includes a generally horizontal portion 134, a vertical portion 136, stabilizer portions 137, 138 and swing arm supports 140. Horizontal portion 134 extends along a floor or other support surface while vertical portion 136 extends upwardly from horizontal portion 134. Horizontal portion 134 supports guide 24 while portion 136 supports swing arms 128 and control interface 123.

Stabilizer portions 137, 138 transversely extend outwardly from horizontal portion 134 to stabilize and support horizontal portion 134. In the example illustrated, stabilizer portion 137 is located at a rear 200 of frame 122 while stabilizer portion 138 is proximate a front 202 of frame 122. In other embodiments, stabilizer portions 137, 138 may have other configurations, may be provided in other locations along frame 122 or may be omitted.

Swing arm supports 140 transversely project from vertical portion 136 proximate to front 202 of frame 122. Swing arm supports 140 pivotably support swing arms 128 for pivotable or rotational movement about axis 148. In particular embodiments, swing arm supports 140 may apply a selected and controlled varying resistance to pivotal movement of swing arms 128. In other embodiments, this feature may be omitted.

Control interface 123 comprises an electronic device configured to interface with a person using exercise device 120. In one embodiment, interface 123 facilitates input of instructions or commands by the person or from an external source. Such commands may be used to set or establish levels of resistance, speed or other settings to vary or control work out parameters. In one embodiment, interface 123 may additionally or alternatively be configured to provide the person with information or feedback regarding the current workout. In particular embodiments, interface 123 may additionally be configured to provide a person using exercise device 120 with information regarding exercise goals, past workouts, recommended settings or entertainment information, such as news, videos or music. In one embodiment, control interface 123 may be configured to communicate with other external electronic devices, such as other computers, servers or portable devices in a wired or wireless fashion.

In one embodiment, interface 123 may include one or more displays that provide the user with visual information. In one embodiment, interface 123 may additionally include one or more speakers providing audible information or entertainment. Interface 123 may additionally include one or more microphones facilitating entry of audible commands in addition to or as an alternative to manual interfaces, such as touchpads, push buttons, slides, toggles, switches or touch screens.

Guide 124 comprises an arrangement of one or more structures or one or more mechanisms configured to facilitate movement of foot links 126 relative to frame 122 in one or more paths or manners. Guide 124 controls movement of foot links 126 such that motion or movement of foot links 26 has a reciprocating component. In the embodiment illustrated, guide 24 is configured such that foot links 126 reciprocate in an alternating fashion with respect to one another generally towards and away from control interface 23 in forward and rearward directions. In the example illustrated, guide 124 is configured such that rearward portions of foot links 126 are constrained to move in an orbital path such that the overall motion of foot links 126 is elliptical.

Figure 2:
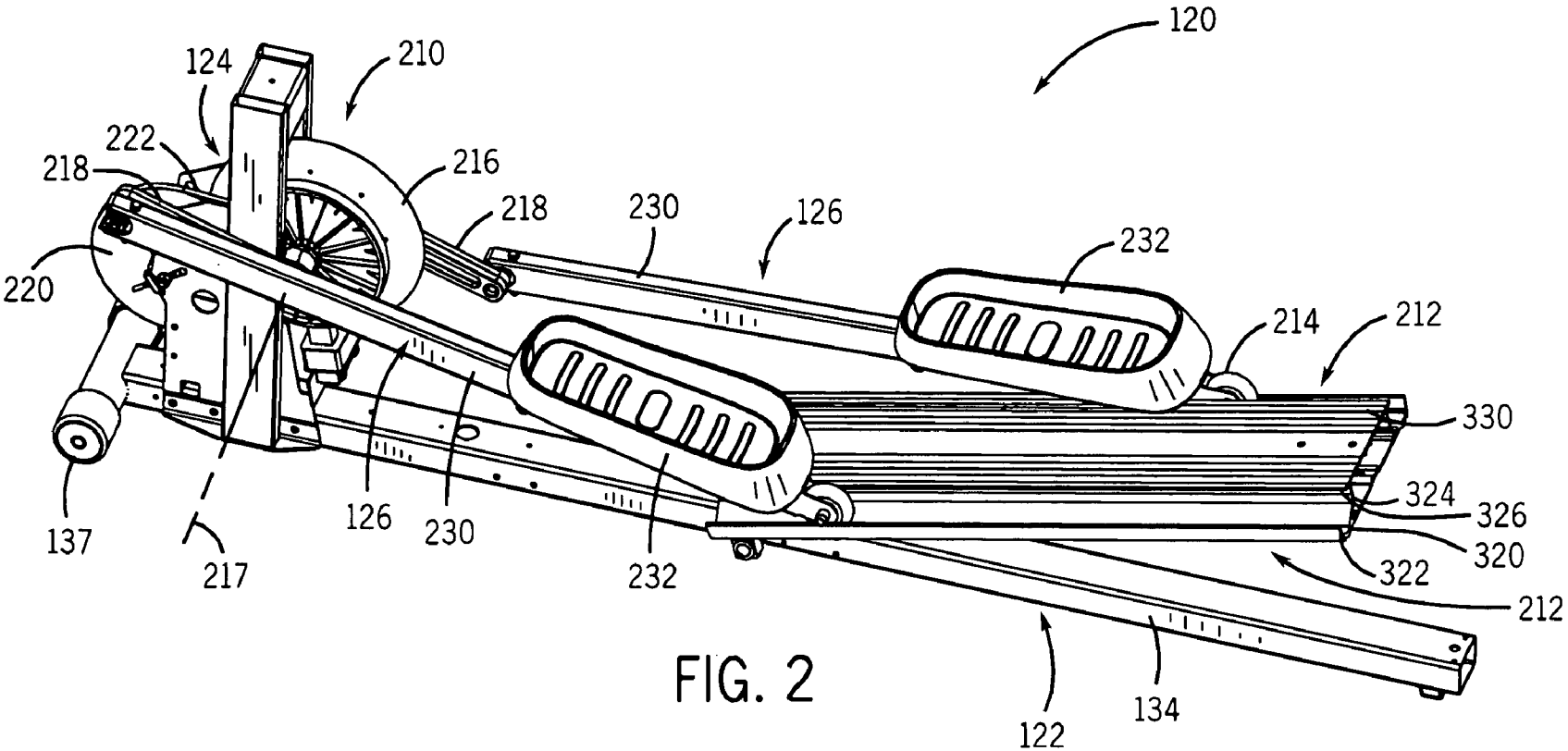
FIG. 2 is another top perspective view of the exercise device of FIG. I with portions removed for purposes of illustration according to an example embodiment.

As shown in more detail by FIG. 2, guide 124 includes orbital mechanism 210, guide tracks 212 and engagement rollers 214. Orbital mechanism 210 comprises a mechanism operably connected to rearward portions of foot links 126 and configured so as to constrain movement of rear portions of foot links 126 in an orbital path. In the embodiment illustrated, orbital mechanism 210 comprises a flywheel 216 rotationally supported about a central axis 217 and a pair of crank arms 218, wherein one of the crank arms 216, 218 has a first end rotationally supported about the central axis 217 and a second end rotationally connected to one of foot links 126 and wherein the other of the crank arms 216, 218 has a first end rotationally supported about the central axis and a second end rotationally connected to the other of foot links 126. An example orbital mechanism 210 is described in co-pending U.S. patent application Ser. No. 11/054,376, published on Aug. 24, 2006 as publication US 2006/0189445, the full disclosure of which is hereby incorporated by reference.

As further shown by FIG. 2, in the example embodiment illustrated, orbital mechanism 210 additionally includes resistance supply 220. Resistance supply 220 is operably coupled to flywheel 216 via a belt or pulley 222. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Resistance supply 220 provides resistance against the rotation a flywheel 216 about axis 217. In the example illustrated resistance supply 220 comprises a friction brake assembly configured to be adjusted or set at different levels of friction, allowing a user to select a degree a resistance that he or she must overcome during exercise. In other embodiments, resistance supply 220 may have other configurations or may be omitted.

Guide tracks 212 comprise elongate surfaces proximate a forward end of foot links 126 and configured to guide and direct reciprocal movement of a forward end of foot links 126. In the embodiment illustrated down a guide tracks 212 are inclined. For example, in one embodiment, guide tracks 212 are inclined at approximately 30 degrees. Guide tracks 212 receive engagement rollers 214.

Engagement rollers 214 comprise rollers rotationally supported at forward portion of foot links 126. Engagement rollers 214 are configured to roll and move along their respective guide tracks 212. As will be described hereafter, guide tracks 212 and engagement rollers 214 who operate with one another to retain engagement rollers 214 relative to guide tracks 212 in a reliable, compact and less complex manner.

Each foot link 126 comprises one or more structures configured to engage a person's leg or foot such that movement of the person's leg or foot causes movement of foot link 126. In the embodiment illustrated, each foot link 126 includes a support 230 and a foot rest 232. Support 230 comprises an elongate bar, rod or otherwise rigid structure having a forward end 224 supporting engagement roller 214 and a rear end 226 connected to orbital mechanism 210. Each foot rest 232 comprises a pedal or other surface upon which a person may place his or her foot to transfer force to foot link 126. In one embodiment, foot rests 232 are configured to form toe straps and/or toe and heel cups which aid in forward motion recovery at the end of a rearward or forward striding motion of a user's foot.

As shown by FIG. 1, swing arms 128 comprise one or more structures configured to be gripped by a person's hand and to be reciprocated to exercise a person's arms and upper body. Each swing arm 128 includes a gripping portion 142, an intermediate portion 144 pivotably connected to support 140 of frame 122 and an end portion 146 pivotably connected to connection link 130. Gripping portion 142 comprises that portion of swing arm 128 configured to be grasped or gripped by a person's hand. Intermediate portion 144 facilitates pivotal movement of swing arm 128 about the substantially horizontal axis 148. Although swing arms 128 are illustrated as being bowed, in other embodiments, swing arms 128 may have other shapes, relative dimensions and configurations.

Each connection link 130 comprises one or more segments or links configured to connect foot link 126 and swing arm 128 such that movement of foot link 126 and swing arm 128 is coordinated. In one embodiment, connection link 130 is configured and appropriately connected to foot link 126 and swing arm 128 such that when foot link 126 is moving forwardly (towards control interface 123), swing arm 128 is moving rearwardly. When foot link 126 is moving rearwardly, swing arm 128 is moving forwardly. In other words, when foot link 126 is in a forward most position, the connection between connection link 130 and swing arm 128 is on an opposite side of axis 148 as gripping portion 142. In some embodiments, connection links 130 may be disconnected from either foot links or 126 or swing arms 128. In still other embodiment, connection links 130 may be omitted, wherein swing arms 128 swing independent of foot links 126 or are stationary During exercise of a person using exercise device 120, forces that are exerted upon foot rest 232 by a person's feet may have a vertical component, tending to lift the link 126 and rollers 214 from tracks 212. In embodiments where swing arms 128 are connected to foot links 126, forces exerted upon swing arms 126 may also tend to lift the link 126 and rollers 214 relative to tracks 212. In circumstances where guide tracks 212, serving as the ramp, are either set or are adjusted to a relatively large inclination angle, the tendency of rollers 214 to separate from tracks 212 may be greater.

During such lifting of foot links 126 and rollers 214, guide tracks 212 and rollers 214 cooperate to retain rollers 214 relative to tracks 212. In particular, guide tracks 212 and rollers 214 cooperate to horizontally or laterally retain rollers 214 relative to tracks 212. At the same time, guide tracks 212 and rollers 214 additionally cooperate to vertically retain rollers 214 relative to tracks 212. By limiting an extent to which rollers 214 may be separated from tracks 212, exercise device 120 provides a more smooth and stable feel to the person exercising during reciprocation of foot links 126 along tracks 212.

Figure 3:
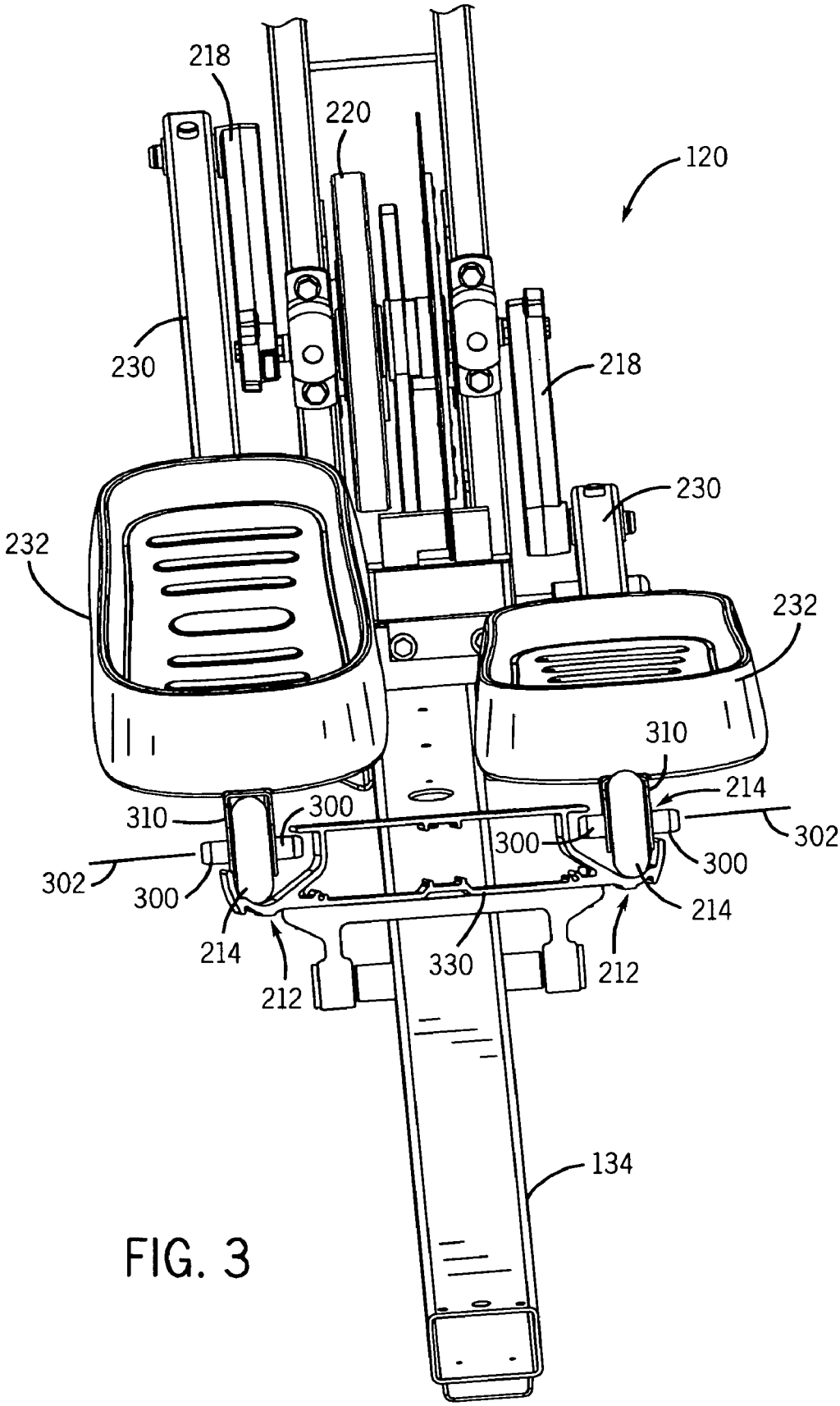
FIG. 3 is a front perspective view of the exercise device of FIG. 2 according to an example embodiment.
Figure 4:
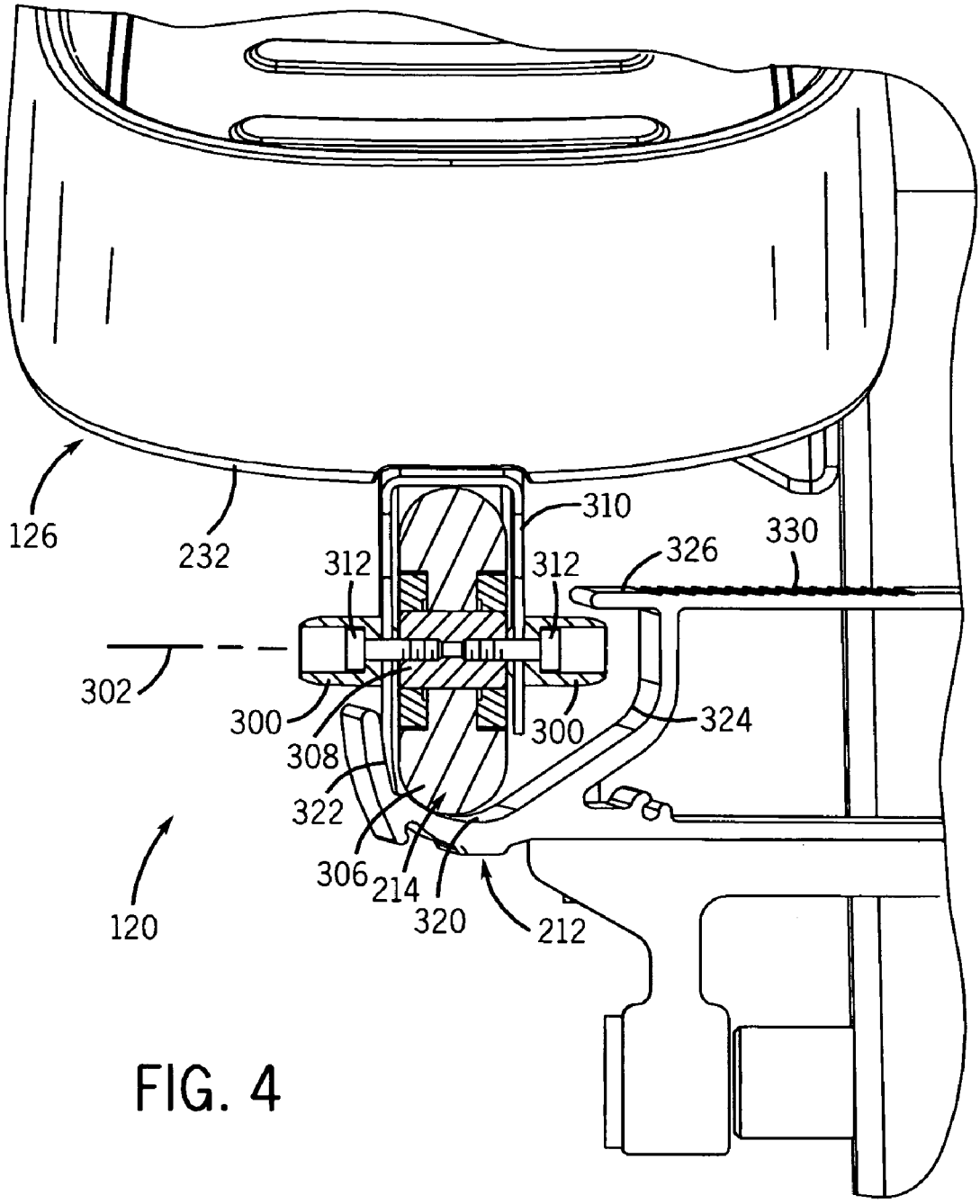
FIG. 4 is a fragmentary sectional view of a portion of the exercise device of FIG. 3 according to an example embodiment.

FIGS. 3 and 4 illustrate tracks 212 and rollers 214 of exercise device 120 in more detail. As shown by FIG. 3, exercise device 120 includes projections 300 associated with each roller 214. Projections 300 extend from rollers 214 and extend about and along the rotation all axes 302 of rollers 214. Because projection 300 extend along the rotational axes 302 of rollers 214, projections 300 have reduced impact upon the smooth rotation of rollers 214. Moreover, as will be described hereafter, projections 300 may be secured to rollers 214 using already existing mounting structures and/or fasteners. Projections 300 assist to retain rollers 214 along tracks 212.

In the particular embodiment illustrated, a projection 300 is provided on both sides of each roller 214. As a result, symmetry of appearance and weight distribution are achieved. In other embodiments, projection 300 and alternatively extend only from a single side of rollers 214.

FIG. 4 is a sectional view illustrating one of rollers 214 and one of projections 300 in more detail. As shown by FIG. 4, each roller 214 includes an outer roller member 306 and internal roller bearing 308. Each roller is coupled to the associated foot link 126 by a yoke 310 and one or more fasteners 312. In the example illustrated, fasteners 312 serve multiple purposes by connecting each roller 214 to the yoke 310 and by also connecting projections 300 to yoke 310 and to roller 214 along the rotational axis 302 of roller 214. As a result, projections 300 are more easily mounted to roller 214 and are more compact in nature. In other embodiments, projections 300 may alternatively connect to and extend from yoke 310 at other locations not in alignment with rotational axis 302.

As further shown by FIG. 4, each track 212 includes an inclined floor 320, an outer side wall 322, an inner side wall 324 and an overhang 326. Inclined floor 320 provides a surface against which a bottom of roller member 306 contacts as it rotates about axis 302. In the example illustrated, floor 320 as a concave shape to assistant horizontally retaining roller 214 within track to 12 and upon floor 320. In other embodiments, floor 320 may be flat or have other shapes.

Outer side wall 322 and inner side wall 324 project upwardly from opposite sides of floor 320 along sides of roller member 306. Sidewalls 320 and 324 assist in horizontally retaining roller 214 within track 212 by horizontally capturing a lower portion of roller member 306 there between. In the example illustrated, sidewalls 322 and 324 are outwardly angled with respect to roller member 306 and do not contact roller member 306 while roller member 306 is centered over floor 320. As a result, sidewalls 306 do not resist rotation of roller members 306 and movement of rollers 214 along track 212. In the example illustrated, sidewalls 322 and 324 are integrally formed as part of a single unitary body with floor 320, reducing fabrication and assembly costs. In other embodiments, sidewalls 322 and 324 may be mounted to one another or may be provided by distinct structures that a positioned proximate to opposite sides of floor 320.

Overhang 326 comprises one or more structures projecting or extending from one of sidewalls 322, 324 towards a side of roller member 306 above one of projections 300. Overhang 326 continuously extends along substantially the entire length of track 212 along which roller 214 travels. As a result, overhang 326 cooperates with floor 312 to guide and vertically retain roller 214 within track 212 as roller 214 travels up and down along track 212.

Because overhang 326 extends just above projection 300 and below a top of roller member 306, the extent to which vertical member 306 may actually rise from floor 320 is limited. Because overhang 326 contacts projection 300 rather than contacting the rolling roller member 306, the person exercising does not experience a jolt or abrupt breaking as might be the case if overhang 326 were alternatively configured to extend over roller member 306 and to contact roller member 306 during retention. Because roller member 306 is not completely contained within an enclosure for purposes of retention, roller 212 may be more easily inspected and more easily assembled or inserted into track 212. Overall, overhang 326 provides a cost-effective and less complex mechanism for retaining roller 214 along track 212 during use of exercise device 120.

Although overhang 326 is illustrated as continuously extending along the length of track 212, in other embodiments, overhang 326 may alternatively intermittently extend along the length of track 212, wherein the spacing between such segments is less than a diameter of projection 300. Although less desirable, in other embodiments, overhang 326 may alternatively be located intermittently along track 212, wherein the spacing between segments of overhang 326 is smaller or absent along portions of track 212 at which roller 214 is more likely to separate from track 212. Although overhang 326 is illustrated as extending from the inner side wall 324, in other embodiments, overhang 326 may alternatively extend from the outer side wall 322 over an outwardly extending projection 300 opposite a side of roller member 306.

As further shown by FIGS. 3 and 4, in the example embodiment illustrated, tracks 212 are provided as a single unitary modular structure which is mounted as a unit to a remainder of exercise device 120. As a result, precise and accurate positioning and alignment of tracks 212 with respect to one another and with respect to foot links 126 is more easily achieved. In the example embodiment illustrated, tracks 212 are integrally formed as part of a single unitary body. In particular, floor 320, sidewalls 322, 324 and overhang 326 of each of tracks to 12 are integrally formed as a single unitary body with an intermediate connection span 330 extending between the tracks 212. As shown by FIG. 3, the connection span 330 as well as tracks 212 each have a substantially uniform cross-sectional shape along the entire length of the overall ramp structure that is formed by tracks 212 and span 330. This uniform cross-section facilitates fabrication of the ramp structure using extrusion techniques. In one embodiment, the ramp structure is integrally formed as part of single unitary body from extruded metals, such as aluminum, or extruded polymers.

In other embodiments, tracks 212 may be provided by separate structures which are connected to one another by a separate connecting span. Such connection may be achieved through welding, adhesives, fasteners and the like. In yet another embodiment, tracks 212 may alternatively be separately mounted to a frame of exercise device 120, independent of one another. In yet another embodiment, tracks 212 may have other configurations, wherein each of tracks 212 still serves as a roller guide by including an inclined floor underlying roller 214 and an overhang extending over a projection opposite a side of roller member 306.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise device comprising:

a first member configured to be reciprocatively driven by one or more feet;

a user adjustable resistance supply operatively coupled to the first member;

a first roller rotationally coupled to the first member;

a first projection carried by the first roller to move with the first roller, the first projection extending away from the first roller; and a roller guide comprising:

a first inclined floor underlying the first roller; and a first overhang extending over the first projection opposite a first side of the first roller, wherein the first roller and the first projection carried by the first roller are movable relative to the guide between a first position in which the first overhang contacts the first projection to limit movement of the first roller and a second position in which the first overhang is out of contact with the first projection.

2. The exercise device of claim 1, wherein the first inclined floor and the first overhang are integrally formed as part of a single unitary body.

3. The exercise device of claim 1, wherein the roller guide includes a first side wall extending upwardly from the first inclined floor along the first side of the first roller opposite to the first projection.

4. The exercise device of claim 3, wherein the first roller guide includes a second side wall extending upwardly from the first inclined floor along a second opposite side of the first roller.

5. The exercise device of claim 4, wherein the first inclined floor, the first overhang, the first side wall and the second side wall are integrally formed as part of a single unitary body.

6. The exercise device of claim 5 further comprising:

a second member configured to be driven by one or more feet;

a second roller rotationally coupled to the second member;

a second projection carried by the second roller to move with the second roller, the second projection extending away from the second roller along a rotational axis of the second roller; and a second roller guide comprising:

a second inclined floor underlying the second roller; and a second overhang extending over the projection opposite a first side of the second roller, wherein the second roller and the second projection carried by the second roller are movable relative to the second guide between a third position in which the second overhang contacts the second projection to limit movement of the second roller and a fourth position in which the second overhang is out of contact with the second projection.

7. The exercise device of claim 6, wherein the first member has a first portion coupled to the first roller and a second portion configured to rotate in a circle about an axis.

8. The exercise device of claim 6 further comprising a first swing arm coupled to the first member and configured to move with movement of the first member and a second swing arm coupled with a second member configured to move with movement of the second member.

9. The exercise device of claim 6, wherein the second roller guide includes a third side wall extending upwardly from the second inclined floor along the first side of the second roller opposite to the second projection.

10. The exercise device of claim 9, wherein the second roller guide includes a fourth side wall extending upwardly from the second inclined floor along a second opposite side of the second roller.

11. The exercise device of claim 10, wherein the second inclined floor, the second overhang, the third side wall and the fourth side wall are integrally formed as part of a single unitary body.

12. The exercise device of claim 1 further comprising a yoke rotationally supporting the first roller relative to the first member, wherein the yoke extends between the first roller and the first projection.

13. The exercise device of claim 1 further comprising:

a yoke coupled to the first member;

a roller bearing coupled to the first roller; and a fastener connecting the first projection and the roller bearing to the yoke.

14. The exercise device of claim 1, wherein the first member has a first portion coupled to the first roller and a second portion configure to rotate in a circle about an axis.

15. The exercise device of claim 1 further comprising a swing arm coupled to the first member and configured to move with movement of the first member.

16. The exercise device of claim 1 further comprising:

a second member configured to be driven by one or more feet;

a second roller rotationally coupled to the second member;

a second projection extending away from the second roller; and a second roller guide comprising:

a second inclined floor underlying the second roller; and a second overhang extending over the projection opposite a first side of the second roller.

17. The exercise device of claim 1, wherein the first projection extend along a rotational axis of the first roller.

18. A method comprising:

reciprocatively moving a first member of an exercise device along a first ramp by rolling a first roller along a first roller guide;

lifting the first roller out of contact with the first ramp during use of the exercise device; and retaining the first roller along the first roller guide while the first roller is lifted out of contact with the first ramp during use of the exercise device with a first overhang capturing and temporarily contacting a first projection extending from a first roller along a rotational axis of the first roller.

19. The method of claim 18 further comprising pivoting a swing arm coupled to the first member in unison with movement of the first member.

20. The method of claim 18 further comprising:

moving a second member along a second ramp by rolling a second roller along a second roller guide; and retaining the second roller along the second roller guide with a second overhang capturing a second projection extending from a second roller along a rotational axis of the second roller.

21. The method of claim 18 further comprising rotating a portion of the first member in a circle about an axis.

22. The exercise device of claim 1, wherein the first roller has a top spaced out of contact with other structures.

23. The exercise device of claim 1 further comprising a crank mechanism operatively coupled to the first member.

* * * * *